United States Patent [19]

Dash et al.

[11] Patent Number: 4,615,773

[45] Date of Patent: Oct. 7, 1986

[54] CHROMIUM-IRON ALLOY PLATING FROM A SOLUTION CONTAINING BOTH HEXAVALENT AND TRIVALENT CHROMIUM

[75] Inventors: John Dash; Arash S. Kasaaian, both of Portland, Oreg.

[73] Assignee: State of Oregon Acting By and Through the State Board of Higher Education on Behalf of Portland State University, Portland, Oreg.

[21] Appl. No.: 827,196

[22] Filed: Feb. 7, 1986

Related U.S. Application Data

[63] Continuation of Ser. No. 607,980, May 7, 1984, abandoned.

[51] Int. Cl.[4] ..... C25D 3/56

[52] U.S. Cl. ..... 204/43.1

[58] Field of Search ..... 204/43.1, 123

[56] References Cited

U.S. PATENT DOCUMENTS 2,693,444 11/1954 Snavely et al. ..... 204/43.1
3,909,372 9/1975 Fujii ..... 204/51
3,917,517 11/1975 Jordan et al. ..... 204/44.7
4,447,299 5/1984 Kasaaian ..... 204/43.1

FOREIGN PATENT DOCUMENTS 2070645 9/1981 United Kingdom ..... 204/51

OTHER PUBLICATIONS

Abner Brenner, "Electrodeposition of Alloys", vol. II, pp. 110–122, (1963).
Paul Morisset et al., "Chromium Plating", pp. 473–474, (1954).
A. T. Vagramyan et al., "Theory and Practice of Chromium Electroplating", pp. 17–25, (1965).
Abner Brenner, Research Paper RP1854, U.S. Dept. Commerce, NBS, vol. 40, Jan. 1948.

*Primary Examiner*—G. L. Kaplan
*Attorney, Agent, or Firm*—Kolisch, Hartwell & Dickinson

[57] ABSTRACT

Electrodeposition of a chromium-iron alloy on a substrate using an electrolyte solution prepared from water, an inorganic hexavalent chromium compound, an inorganic trivalent chromium compound, and an inorganic iron compound, the solution having an adjusted pH lying within the range of 0.5 to 2.0.

6 Claims, No Drawings

CHROMIUM-IRON ALLOY PLATING FROM A SOLUTION CONTAINING BOTH HEXAVALENT AND TRIVALENT CHROMIUM

This application is a continuation of application Ser. No. 607,980 filed May 7, 1984 and now abandoned.

BACKGROUND AND SUMMARY OF THE INVENTION

This invention relates to the plating of a chronium-iron alloy on a substrate, and more particularly to a plating process of this description where excellent current efficiencies are experienced and sound coatings of uniform coloration are produced.

Chromium electroplating baths containing dissolved chrominum trioxide, with chromium ions in the bath solution therefore being hexavalent chromium, are known in the art. A common form of such an electroplating bath contains, in addition to chromium trioxide and water, a catalyst, such as a sulfate catalyst, or a mixture of catalyst, such as a sulfate and a silicofluoride.

While such baths or electrolyte solutions have performed satisfactorily in the electrodeposition of chromium on a substrate, certain disadvantages have attended the use of such plating solutions. For example, current efficiencies have not been as high as would be desirable to obtain efficient plating. Furthermore, such solutions generally have not been employed in the electroplating of a chromium-iron alloy directly on a substrate.

Studies that have been made of electroplating processes utilizing chromic acid, i.e., hexavalent chromium ion baths, have indicated that the appearance on the cathode, i.e., the substrate being plated, of a viscose-type layer which forms over the plating being produced. The layer has a coloring different from the plating solution as a whole. Studies made of this layer indicate that it has a composition different from the plating solution as a whole, and that such contains, in addition to hexavalent chromium ions, a significant concentration of trivalent chromium ions.

Additional studies made of electroplating solutions have indicated that trivalent chromium ions in the plating solution tend to produce thereabout what might be thought of as a shield apparently of an ionic nature. This shield has the effect of inhibiting the acceptance of electrons by trivalent chromium ions from the cathode, and the formation from such ions of metallic chromium deposited on the cathode. These and other studies have indicated that the production of trivalent chromium ions in the vicinity of the cathode in many respects is a parasitic type of reaction effective to consume electricity in the production of the ions from the hexavalent chromium ions in the solution, without such producing appreciable deposits of chromium on the cathode.

This invention is based on the realization that significantly improved electroplating results are obtainable from a hexavalent chromium bath solution where such solution in addition to hexavalent chromium, contains significant amounts of trivalent chromium introduced to the bath solution by the addition to the solution of an inorganic trivalent chromium compound, such as chromic sulfate, chromic chloride, and chromic carbonate.

This invention is further based on the realization that optimum results are obtained when the plating solution is prepared to contain, in addition to trivalent and hexavalent inorganic chromium compounds, a significant amount of an inorganic iron salt or compound, such as ferrous sulfate. The exact mechanics of what occurs with the inclusion in the plating solution of iron ions is not entirely understood. It is believed, however, that such results in an effective destruction or deactivating of the shield above-described which is produced about the trivalent chromium ions resulting in increased susceptibility of these ions to electroplating on the cathode by the acceptance of electrons from the cathode. Furthermore, of course, the advantage results that there is formed on the cathode directly a chromium-iron alloy in the electroplating process. The resulting alloy platings that are produced are of good quality, uniform coloring and produced with high current efficiencies experienced.

A general object of the invention, therefore, is to provide an improved method for electrodepositing a chromium-iron alloy on a substrate.

A more specific object is to provide an improved method of electrodepositing such an alloy which features the use of an electrolyte solution prepared from an inorganic hexavalent chromium compound, an inorganic trivalent chromium compound, and an inorganic iron compound, the electrolyte solution containing the metals of these compounds as cations in the solution.

These and other objects and advantages are attained by the invention, which will become more fully apparent from a reading of the following description and examples given in conjunction therewith.

Describing in more particularity the electrodepositing method of the invention, the electrolyte or plating solutions are aqueous solutions, prepared through mixing inorganic water soluble compounds with water, such introducing into the aqueous solution the various chromium and iron cations desired.

A plating tank, vessel or cell containing the bath solution is provided with one or more anodes, which may be of lead, and one or more cathodes, which constitute the substrate to be plated. A current is established between the anode and cathode structures. The plating process may typically be carried out at temperatures ranging from 20° to 80° C., with the preferred temperature utilized being within the range of 35° to 45° C. With the passage of time, chromium and iron ions in the bath solution become deposited as a chromium-iron alloy on the cathode structure.

Chromium plating may be carried out on various types of cathode substrates. Such include nickel substrates, low-carbon steel substrates, iron substrates, copper substrates, etc. As far as has been observed, the present invention is applicable to all of such commonly employed substrates.

Current efficiency, as the term is used herein, is calculated by determining the mass of the material deposited on the cathodic substrate during the plating process (which may be calculated by determining the weight gain in the plated article), and dividing this quantity by the theoretical mass that would be electrodeposited under 100 percent efficient conditions. This assumes that all the electrons transferred by the current employed in the plating are effective to reduce metal ions in the electrolyte of the bath solution to metal atoms deposited on the cathode structure.

Inorganic trivalent chromium compounds that may be used with advantage in practicing the invention comprise such materials as chromic carbonate, chromic chloride, and chromic sulfate, the latter compound being preferred. The inorganic hexavalent chromium compound in the usual instance comprises chromic trioxide. The inorganic iron compound or salt may comprise ferric chloride, ferrous chloride, ferric sulfate and ferrous sulfate, with good results observed when the ferrous sulfate salt is utilized.

Plating solutions prepared as contemplated, and without pH adjustment, are highly acidic, and typically may have, for example, negative pH values. It has been observed that optimum results are obtained when the pH of the plating solution is adjusted to be within the range of 0.5 to 2.0. Such pH adjustment may be produced by introducing into the solution the required amounts of a strong inorganic base, such as sodium hydroxide or ammonium hydroxide.

The presence of sulfate ions in the solution appears to have a catalytic affect. However, optimum plating efficiencies appear to result when sulfate ion concentration in the plating solution is limited. This may be performed by including in the plating solution a certain amount of barium carbonate. With barium carbonate introduced to the solution a precipitate of barium sulfate in produced which effectively removes sulfate ions from the solution. Barium sulfate production is accompanied with the evolution of carbon dioxide.

Ordinarily, plating solutions prepared as contemplated contain a greater concentration of hexavalent chromium ions than trivalent chromium ions. Thus, in most instances, the solutions are prepared with the mole ratio of hexavalent chromium compound to trivalent chromium compound introduced to the solution being 2:1, or greater.

In the following examples, electroplating was performed in apparatus including a vessel containing 25 mls. of plating bath solution. The substrate plated, or cathode specimen, was a rectangular piece of sheet material having a combined surface area on opposite sides thereof, of 2 cms.$^2$. One hollow cylindrical lead anode was placed in a position surrounding the cathode specimen, which had a surface area submerged in the bath solution of 24 cms.$^2$. Plating was performed on a nickel substrate for a period of one hour. The temperature of the bath solution was maintained at 40° C. A current density with direct current was maintained at 0.25 A (amperes)/cms.$^2$. Quantities of materals indicated are on the basis of additions made to one liter of water to produce the bath solution.

EXAMPLE 1

A plating bath solution was prepared utilizing 250 grams $CrO_3$, 90 grams $FeSO_4.7H_2O$, and 120 grams of $Cr_2(SO_4)_3.5H_2O$. Without pH adjustment, the resulting solution had a negative pH value. The pH of the solution was adjusted by the addition of sodium hydroxide (about 100 grams) to raise the pH to 1.5.

Electroplating was performed with a bath solution so prepared on a number of cathode substrate specimens. Chromium-iron alloy platings resulted on the substrates, that were sound and uniformly gray. Observed current efficiencies in making of the platings were in the range of 40–50 percent.

EXAMPLE 2

Electroplatings were performed utilizing a plating solution prepared as in Example 1, which further included, in the case of one series of platings, 80 grams of barium carbonate, and in the case of another series of platings, 120 grams of barium carbonate. Again, as in Example 1, sound chromium-iron alloy platings were produced of uniform gray coloring and good quality. In the case of the series of platings produced with the addition of 80 grams of barium carbonate, average current efficiency observed was close to 53 percent. In the case of platings performed with a bath solution containing 120 grams of barium carbonate, average current efficiency observed was somewhat greater than 54 percent.

The above set forth examples have been included for the purpose of illustration and not limitation. It is desired to cover all modifications and variations of the invention as would be apparent to one skilled in the art.

It is claimed and desired to secure by Letters Patent:

1. A method of electrodepositing a chromium-iron alloy on a substrate comprising preparing an aqueous electrolyte solution through mixing with water the following ingredients (a) a water-soluble inorganic trivalent chromium compound, (b) a water-soluble inorganic hexavalent chromium compound, and (c) a water-soluble inorganic iron compound, said electrolyte solution containing the metals of said compounds as ions in the solution and the amounts of hexavalent and trivalent compounds added being such that the concentration of hexavalent chromium ions in this solution exceeds the concentration of trivalent chromium ions, said solution further being prepared through hydroxyl ion addition to have a pH within the range of 0.5 to 2.0, immersing said substrate in said electrolyte solution, and passing an electric current through said solution to effect depositing of chromium and iron on said substrate.

2. The method of claim 1, wherein the trivalent chromium compound is a trivalent chromium sulfate salt, and wherein the solution is prepared with the further addition of barium carbonate.

3. The method of claim 1, wherein the iron compound is a ferrous salt, and the pH prepared through hydroxyl ion addition is approximately 1.5.

4. the method of claim 3, wherein the iron compound is ferrous sulfate.

5. A method of electrodepositing a chromium-iron alloy on a substrate comprising preparing an aqueous electrolyte solution through mixing with water the following ingredients (a) a water-soluble inorganic trivalent chromium compound selected from the group consisting of chromic sulfate, chromic chloride and chromic carbonate, (b) ferrous sulfate, and (c) chromium trioxide, said electrolyte solution containing the chromium and iron of said compounds as cations in the solution, the amounts of trivalent chromium compound and chromium trioxide added to the solution being such that the concentration of hexavalent chromium ions exceeds the concentration of trivalent chromium ions in the solution, said solution further including a base introduced in an amount to adjust the pH of the solution to within the range of 0.5 to 2.0, said solution being essentially free of any sulfate compounds other than ferrous sulfate and chromic sulfate, immersing said substrate in said electrolyte solution, and passing an electric current through said solution to effect depositing of chromium and iron on said substrate.

6. The method of claim 5, wherein the trivalent chromium compound is chromic sulfate, and wherein the solution is prepared with the further addition of barium carbonate.

* * * * *